US007530370B2

(12) United States Patent
Gross

(10) Patent No.: US 7,530,370 B2
(45) Date of Patent: May 12, 2009

(54) MARINE VALVE ADAPTER

(76) Inventor: Donald P. Gross, 7240 Standard Dr., Hanover, MD (US) 21076

( * ) Notice: Subject to any disclaimer, the term of this patent is extended or adjusted under 35 U.S.C. 154(b) by 483 days.

(21) Appl. No.: 11/101,670

(22) Filed: Apr. 8, 2005

(65) Prior Publication Data

US 2006/0225799 A1 Oct. 12, 2006

(51) Int. Cl.
*F16K 5/00* (2006.01)
*B13B 13/00* (2006.01)

(52) U.S. Cl. ..... 137/899.2; 251/143; 114/198; 285/390

(58) Field of Classification Search ..... 251/146, 251/147, 152, 143, 148; 285/390, 332; 137/899.2; 114/198
See application file for complete search history.

(56) References Cited

U.S. PATENT DOCUMENTS

| | | | | | |
|---|---|---|---|---|---|
| 558,702 | A * | 4/1896 | Perkins | 114/198 |
| 1,866,643 | A * | 7/1932 | Greear | 114/197 |
| 2,350,598 | A * | 6/1944 | Faville | 165/108 |
| 3,765,364 | A * | 10/1973 | Booth | 114/198 |
| 3,874,317 | A * | 4/1975 | Hikita | 114/198 |
| 3,878,807 | A * | 4/1975 | Reskusic et al. | 114/198 |
| 4,397,445 | A * | 8/1983 | Burquier | 251/149.9 |
| 4,590,960 | A * | 5/1986 | Koble, Jr. | 137/315.08 |
| 4,917,353 | A * | 4/1990 | Riley | 251/148 |
| 4,920,626 | A * | 5/1990 | Nimberger | 285/219 |
| 4,991,621 | A * | 2/1991 | Steudler, Jr. | 137/505.46 |
| 5,305,785 | A * | 4/1994 | Humber | 137/360 |
| 5,340,078 | A * | 8/1994 | Dean | 251/59 |
| 5,429,151 | A | 7/1995 | Millett et al. | |
| 5,546,973 | A * | 8/1996 | Scaramucci | 137/15.09 |
| 5,546,978 | A * | 8/1996 | Parker | 137/315.01 |
| 5,566,708 | A * | 10/1996 | Hobbs, Jr. | 137/360 |
| 5,595,212 | A * | 1/1997 | Warshawsky et al. | 137/360 |
| 5,615,703 | A * | 4/1997 | Kopp | 137/360 |
| 5,673,896 | A * | 10/1997 | Gillen | 251/315.14 |
| 6,102,067 | A * | 8/2000 | Orlando | 137/315.08 |
| 6,164,318 | A * | 12/2000 | Dixon | 137/385 |
| 6,227,133 | B1 * | 5/2001 | Gross | 114/198 |
| 6,578,876 | B2 * | 6/2003 | Guertin, Jr. | 285/148.19 |
| 2003/0122096 | A1 * | 7/2003 | Bush | 251/148 |
| 2005/0230650 | A1 * | 10/2005 | Peterson | 251/148 |
| 2006/0068657 | A1 * | 3/2006 | Csitari | 440/88 N |

OTHER PUBLICATIONS

Parker Hannifin Corporation, Pipe Fittings and Port Adapters Catalog, Date: unknown.*

* cited by examiner

*Primary Examiner*—John Fox
(74) *Attorney, Agent, or Firm*—Rankin, Hill & Clark LLP

(57) ABSTRACT

The invention is directed to an adapter used in a marine fluid handling system to prevent thread mismatch between a thru-hull fitting and in-line valve. The adapter includes a head with a male NPT thread and a bore with a female NPS thread. The adapter is threaded to a thru-hull fitting with a male NPS thread that extends through a hole in a boat hull. The adapter is also attached to an in-line valve having a female NPT thread. The valve may be mechanically fastened to the adapter to prevent thread disengagement. When the valve fails, the valve is easily removed from the adapter that remains attached to the boat hull, and a replacement valve is attached to the adapter.

18 Claims, 3 Drawing Sheets

MARINE VALVE ADAPTER

BACKGROUND OF THE INVENTION

1. Field of the Invention

The present invention relates to valve adapters and more specifically to a valve adapter used to prevent thread mismatch on a marine installation.

2. Description of the Related Art

NPS (National Pipe Straight) threads are intended to provide a loose mechanical joint between similarly threaded components, and are not capable of providing a watertight seal. NPT (National Pipe Taper) threads are intended to provide a watertight joint between similarly threaded components.

There are two common types of ball valves employed in the marine industry: in-line valves that are provided with NPT thread at each end, and flanged valves (seacocks) which include an NPT thread at an outlet end and an NPS thread at a flanged inlet end. NPS threads are used at the flanged inlet end of seacocks and on thru-hull fittings because of the variable thickness of vessel hulls through which the thru-hull fitting must pass before threading into the flanged seacock. Flanged seacocks are desirable for below waterline use because the flange portion of the valve spreads the mechanical load over a greater area, thus providing increased support for the valve and the connected components. Flanged seacocks are generally attached to a boat hull at the flange with fiberglass, adhesives, and/or mechanical fasteners to strengthen the installation. However, it is extremely difficult to remove a seacock installed in this manner from the boat hull as may be necessary to replace the seacock.

The less costly in-line valve design is suitable for and most commonly employed in inboard systems (fuel systems, water pressure systems, etc.). In-line valves are not recommended for through-the-hull use, but are often improperly used in below waterline through-the-hull applications by screwing them directly onto a standard thru-hull fitting. This creates a threads mis-match (NPS of the fitting into NPT of the valve), resulting in unsafe minimal thread engagement between the two incompatible components. Additionally, the use of an in-line valve in this manner provides inadequate structural strength because the flangeless in-line valve and connected components are supported only by the NPS-threaded thru-hull fitting and the amount of engagement (only a few threads) between the two components.

An improved system is required that provides the strength of a seacock valve system and the easy replacement of an in-line valve system.

BRIEF SUMMARY OF THE INVENTION

The present invention overcomes disadvantages in the prior art by providing an adapter that has no parts that might fail or need replacement, can be integrally affixed to a boat hull, and be available for attachment of an in-line valve. If the in-line valve attached to the adapter fails and must be replaced, the in-line valve is easily disengaged from the adapter and a new valve attached. The adapter prevents the mismatching of threads between a valve having NPT threads and a thru-hull fitting having NPS threads, as is common in the art.

The adapter includes a flanged section, neck and head, all formed in one piece. The head includes male NPT threads for engaging the in-line valve. The flanged section is securely fastened to the hull with mechanical fasteners and/or is affixed to the hull with fiberglass or adhesives. The adapter also includes a bore having an inlet end and an outlet end. The inlet end has female NPS threads for receiving a thru-hull fitting.

These and other aspects of the invention are herein described in particularized detail with reference to the accompanying figures.

DETAILED DESCRIPTION OF THE INVENTION

Figure 3B:
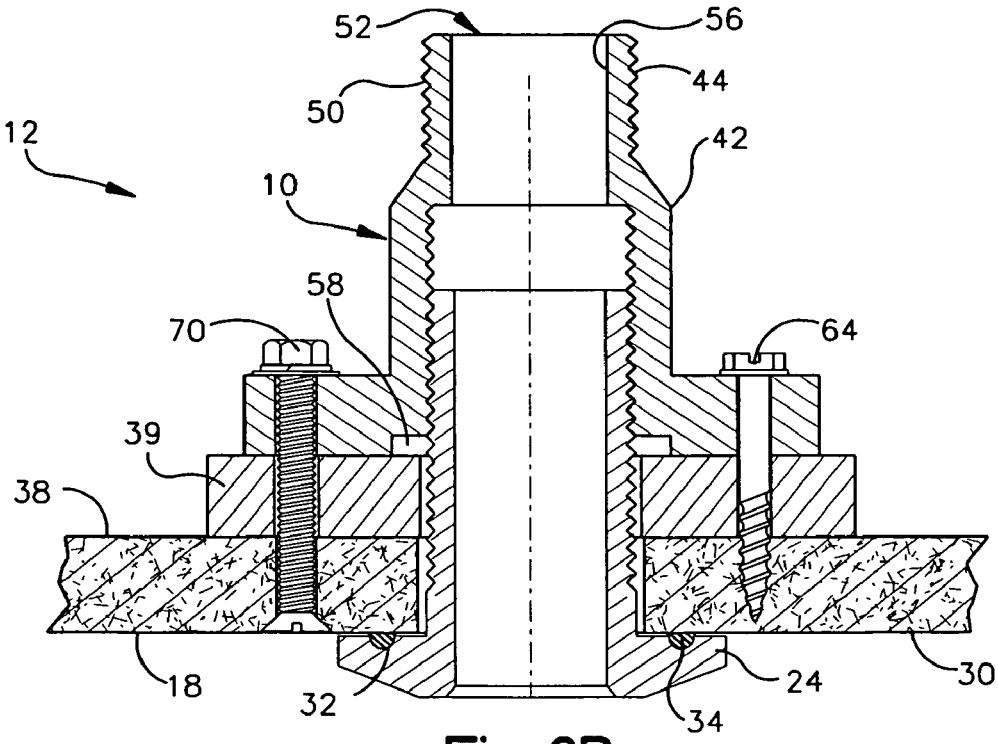
FIG. 3*b* is a top view of a second embodiment of a fluid handling system utilizing the adapter of the present invention.
Figure 3A:
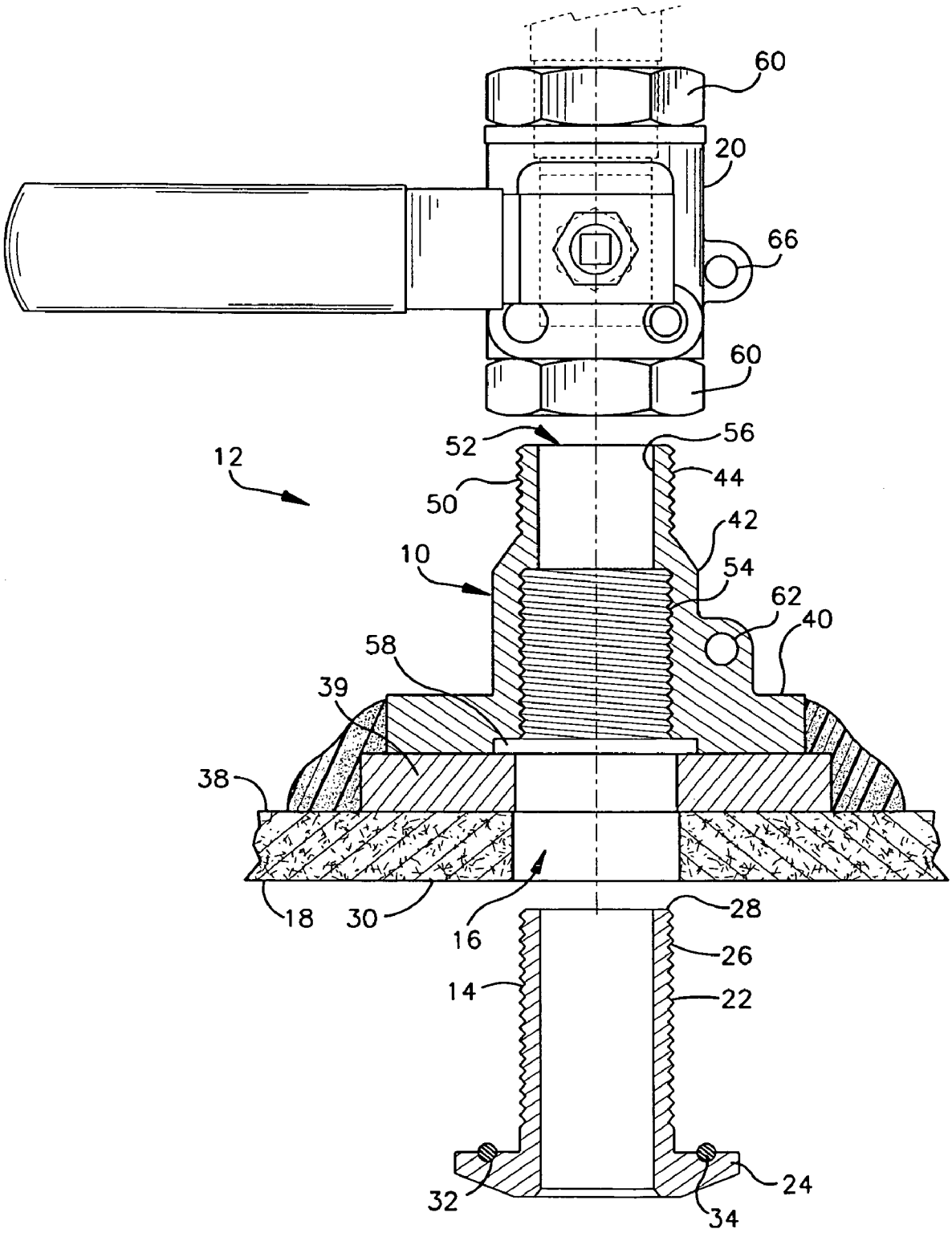
FIG. 3*a* is a top view of a first embodiment of a fluid handling system utilizing the adapter of the present invention.

Referring to FIGS. 3*a* and 3*b*, the present invention is directed to a valve adapter 10 used in a marine fluid handling system 12. The handling system 12 includes a fitting 14 that passes through a hole 16 in a section of the boat's hull 18, the adapter 10 of the present invention that engages the fitting 14, and an in-line valve 20 that engages the adapter on the opposite side of the fitting 14.

The hull section 18 of the boat is any section that is generally flat. The boat hull 18 is any common material from which boats are manufactured, such as fiberglass, wood, aluminum, or steel. Typically, at the desired hull section 18 position, certain apparatus such as a pump, strainer, engine or heat exchanger is situated on the inside of the boat and requires either a supply of seawater or needs to discharge waste water outside of the boat. To facilitate fluid transfer, a hole 16 for a thru-hull fitting 14 is formed in the hull section 18 passing from an inner side of the hull 18 to an outer side.

The fitting 14 is made from a material that is galvanically compatible with the materials of the hull, adapter and valve, and includes a generally cylindrical body 22 with a flanged first end 24. The cylindrical body 22 includes male threads 26 that extend from a position adjacent to the flanged first end 24 to a second, opposite end 28. The outer diameter of the generally cylindrical body 22 is only slightly smaller than the diameter of the hole 16 within the hull section 18, thus, providing a connection that does not shift significantly within the hull section 18. The flanged first end 24 of the fitting has a diameter greater than the generally cylindrical body 22. When the fitting 14 is in place, the flanged first end 24 abuts the outer side 30 of the hull section 18. The flanged first end 24 preferably includes a groove 32 on a side adjacent to the hull 18 where an O-ring 34 is placed or caulking material is applied to improve the seal between the fitting 14 and the hull 18.

Preferably, a backing board 39 is placed between the inner side 38 of the hull section 18 and the adapter. The backing board 39 provides additional strength and rigidity to the hull section 18 where attachment of the adapter 10 occurs. The backing board is provided with fastener holes aligned with fastener holes 46 on the adapter 10. The backing board 39 may be a separate piece or a section of the hull 18 having increased thickness.

Figure 1:
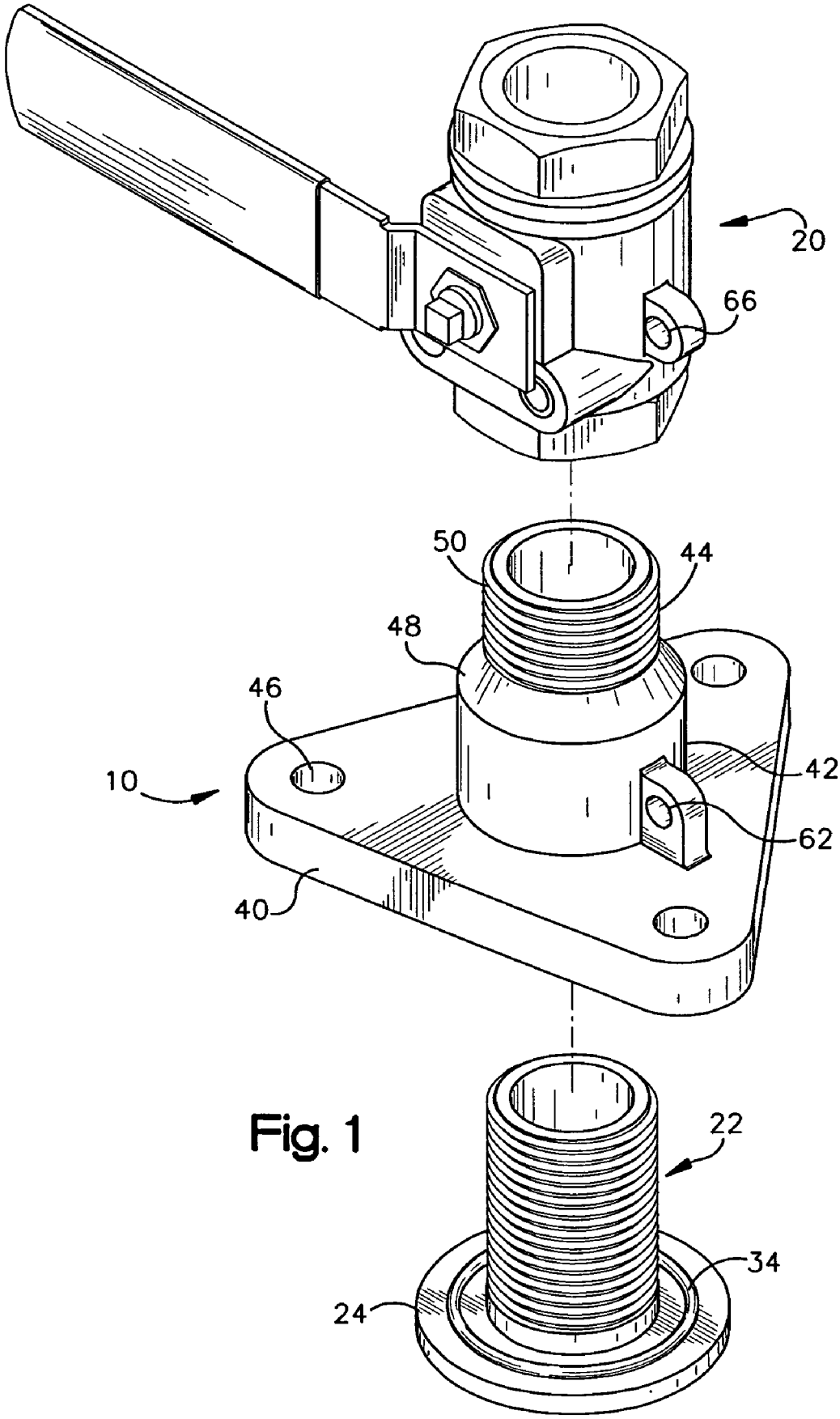
FIG. 1 is an exploded view of an adapter of the present invention in a marine fluid handling system.

The adapter 10 is made from a material that is galvanically compatible with the materials of the hull 18, fitting 14, backing board 39, and valve 20, and is placed on the inner side 38 of the hull section 18 opposite the fitting 14. The adapter 10 includes an adapter flange 40, neck 42 and head 44 all formed together as a unitary or one-piece structure. Referring to FIG. 1, the adapter flange 40 is a triangular solid and defines three fastener holes 46 adjacent each of the three ends, further defined on a fastener circle of sufficient diameter to permit fastening through the adapter 10, backing board 39, and through the hull section 18, without interference with the outside diameter of the flanged end 24 of the fitting 14. The adapter flange 40 abuts the inner side 38 of the backing board 39, if present, and may be fastened to the hull 18 (see FIG. 3*b*) and/or glassed-in by using fiberglass (see FIG. 3*a*), adhesives or both, and thereby integrally affixed to the hull 18.

Referring to FIGS. 3*a* and 3*b*, the neck 42 of the adapter extends between the adapter flange 40 and the adapter head 44. The neck 42 is not threaded and includes a beveled portion 48 adjacent to the head 44, and is fitted with a locking eye 62 to allow the installer to mechanically fasten the in-line valve 20 to the adaptor 10. The neck 42 has a generally circular cross section, and is located in the center of the triangular adapter flange 40.

The neck 42 extends from the head 44 to the end of the adapter 10 opposite the hull section 18. The head 44 has a smaller diameter than the neck 42 and includes a male NPT thread 50. The head 44 has a generally circular cross section and is located in the center of the triangular adapter flange 40.

A bore 52 having first and second sections 54 and 56 of different diameters is placed through the center of the adapter 10. The first, or inlet bore section 54 reaches from the end of the adapter 10 adjacent to the boat hull 18 to the second, or outlet bore section 56 and includes a female NPS thread. The female NPS thread receives the male NPS thread 26 of the fitting 14. The first bore section 54 has a counter-bore 58 to receive caulking material for sealing between the adapter 10 and backing board 39. The diameter of the second bore section 56 is less that the diameter of the first bore section 54. The second bore section 56 reaches from the first bore section 54 to the adapter end opposite of the hull section 18. To assure an unrestricted flow path into or out of the marine vessel, bore 52 of the adapter 10 is provided to match the bore 68 of the fitting 14.

Figure 2:
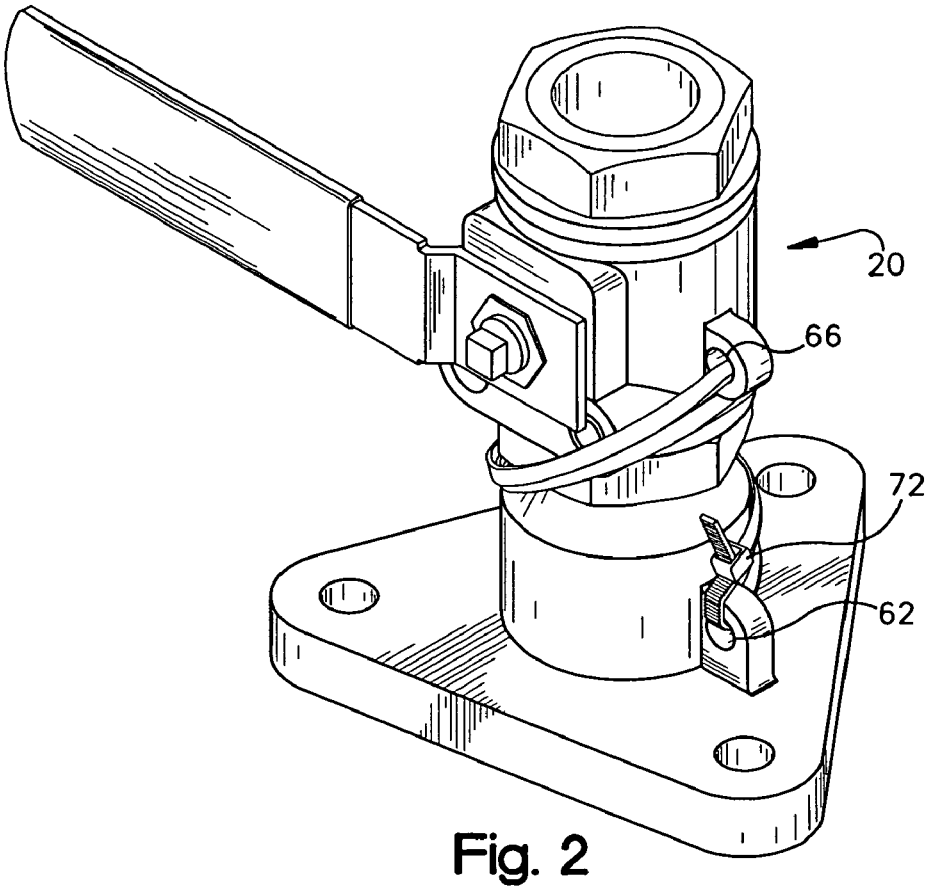
FIG. 2 is a perspective view of an adapter of the present invention assembled within a marine fluid handling system.

The valve 20 is an in-line ball valve with inlet and outlet ports threaded female NPT 60 at each end. A typical valve is the Groco Type IBV or IBV-S manufactured by GROCO of Hanover, Md. Referring to FIG. 2, the valve 20 is provided with a locking eye 66 enabling the installer to mechanically fasten the in-line valve 20 to the locking eye 62 of the adaptor 10 using a wire tie 72 as described below.

Referring back to FIGS. 3*a* and 3*b*, the adapter 10 of the present invention may be used as original equipment in or retrofitted into a marine fluid handling system 12. After a suitably sized hole 16 is made in a desired section of the hull 18, the adapter 10 is attached to the boat hull 18 using fiberglass as shown in FIG. 3*a*, or using mechanical fasteners 64 or 70 as shown in FIG. 3*b*. Two different types of mechanical fasteners 64, 70 are illustrated, but preferably all mechanical fasteners of a single type are used in an installation. The fitting 14 is then placed through the hole 16 from the outside of the boat and threaded to the adapter 10. The male NPS threads 26 of the fitting 14 match the female NPS threads of the adapter 10 to provide a loose fitting mechanical joint that effectively compresses the hull section 18 between the adapter flange 40, backing board 39, and the fitting flange 24. As the fitting 14 is tightened to the adapter 10, the O-ring 34 or the caulking material on the fitting 14 is compressed against the outer wall 30 of the hull 18 to provide a tight seal. Additionally, the caulking between the adapter 10 and the backing board 39 of the hull 18 is compressed to provide a tight seal.

The valve 20 is then threaded into place on the head 44 of the adapter 10. The NPT threads 50 of the adapter 10 match the NPT threads of the valve 20 to provide a joint that does not leak.

Generally, when components with matching NPT threads are fastened together, they will remain so until intentionally separated. To provide an added measure of safety, and to prevent unwanted vibration-induced loosening of the valve 20 from the adapter 10, a wire tie 72, plastic electrical tie, or other simple means may be employed between in-line valve 20 locking eye 66 and the adapter 10 locking eye 62. If the valve 20 breaks or becomes worn out, the wire tie 72 is removed, and valve 20 is simply unthreaded from the adapter 10 and replaced with a new valve 20 without removing the adapter 10 or thru-hull fitting 14 from the hull section 18.

The adapter 10 of the present invention provides a significant advantage over known systems. Because the adapter 10 may be held in place with mechanical fasteners 64 or 70, fiberglass and/or adhesives, strength is provided to the system, and stress is distributed over a greater area. Additionally, when the in-line valve 20 is replaced, there is no chance for threads on the new valve 20 to be mismatched with threads on a thru-hull fitting 14.

Although the invention has been shown and described with reference to certain preferred and alternate embodiments, the invention is not limited to these specific embodiments. Minor variations to materials of construction and insubstantial differences in the various combinations of materials and methods of application may occur to those of ordinary skill in the art while remaining within the scope of the invention as claimed and equivalents.

The invention claimed is:

1. An adapter for use in a marine fluid handling system that prevents thread mismatch between components, wherein fluid passes through a section of a boat hull, the system including a threaded fitting extending from an outer side of the hull section to an inner side of the hull section and a threaded valve on the inner side of the hull to selectively stop fluid flow, the adapter comprising:

a head including a male NPT thread for engagement with the valve; and a bore including a female NPS thread for receiving the fitting.

2. The adapter of claim 1, wherein the adapter includes an adapter flange that is attachable to an inner surface of the boat hull using mechanical fasteners.

3. The adapter of claim 1, wherein the adapter includes an adapter flange that is attachable to an inner surface of the boat hull using at least one of fiberglass and adhesives.

4. The adapter of claim 2, wherein the adapter flange is attachable to the inner surface of the boat hull using fiberglass.

5. The adapter of claim 2, wherein the adapter includes a neck intermediate the head and adapter flange.

6. The adapter of claim 1, wherein the adapter includes a second bore adjacent to the first bore, the second bore having a diameter that is less than a diameter of the first bore.

7. The adapter of claim 1, wherein the adapter has an eye for mechanical connection to the threaded valve, and wherein said connection to the eye prevents loosening of the valve from the adapter.

8. The adapter of claim 1, wherein the female NPS thread of the bore has the same thread pitch, angle, and depth as the male NPT thread of the head, which is of equal pipe size and nominal diameter.

9. The adapter of claim 1, wherein the adapter includes an adapter flange that is attachable to an inner surface of the boat hull using both fiberglass and adhesives.

10. A marine fluid handling system that prevents thread mismatch between components, comprising:

a threaded fitting extendable from an outer side of a boat hull to an inner side of the hull;

an adapter including:

a head including a male NPT thread;

a bore including a female NPS thread for engaging the fitting; and a threaded valve attachable to the head of the adapter on the inner side of the hull to stop fluid flow, the valve being operable to regulate fluid flow through the fitting and adapter.

11. The marine fluid handling system of claim 10, wherein the adapter further includes a flange that is integrally affixed to the boat hull.

12. The marine fluid handling system of claim 11, wherein the adapter flange is affixed to an inner surface of the boat hull using mechanical fasteners.

13. The marine fluid handling system of claim 10, wherein the adapter flange is attachable to an inner surface of the boat hull using fiberglass or adhesives.

14. The marine fluid handling system of claim 11, wherein the adapter flange is affixed to an inner surface of the boat hull using at least one of fiberglass and adhesives.

15. The marine fluid handling system of claim 10, wherein the adapter includes a second bore adjacent to the first bore, the second bore having a diameter that is less than a diameter of the first bore.

16. The marine fluid handling system of claim 10, wherein the threaded valve is an in-line ball valve.

17. The marine fluid handling system of claim 11, wherein the adapter flange is affixed to an inner surface of the boat hull using both fiberglass and adhesives.

18. The marine fluid handling system of claim 10, wherein the adapter flange is affixed to a backing board and affixed to the inner surface of the boat hull, the backing board being disposed between the adapter flange and boat hull.

* * * * *